US007278862B2

(12) United States Patent
Nagashima et al.

(10) Patent No.: US 7,278,862 B2
(45) Date of Patent: Oct. 9, 2007

(54) CONNECTOR

(75) Inventors: Shinyu Nagashima, Yokkaichi (JP); Akihito Maegawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 16 days.

(21) Appl. No.: 11/185,639

(22) Filed: Jul. 19, 2005

(65) Prior Publication Data

US 2006/0019516 A1 Jan. 26, 2006

(30) Foreign Application Priority Data

Jul. 20, 2004 (JP) ..... 2004-211855

(51) Int. Cl.
*H01R 12/00* (2006.01)

(52) U.S. Cl. ..... 439/79

(58) Field of Classification Search ..... 439/79
See application file for complete search history.

(56) References Cited

U.S. PATENT DOCUMENTS 5,215,471 A * 6/1993 Reymond et al. ..... 439/67
5,382,169 A 1/1995 Bailey et al.
5,833,475 A * 11/1998 Mitra ..... 439/79
5,926,952 A 7/1999 Ito
6,256,572 B1 7/2001 Rea
6,837,746 B2 1/2005 Okamoto

FOREIGN PATENT DOCUMENTS

JP 5-326049 10/1993

* cited by examiner

*Primary Examiner*—Briggitte R. Hammond
(74) *Attorney, Agent, or Firm*—Gerald E. Hespos; Anthony J. Casella

(57) ABSTRACT

A housing (11) has a terminal holding portion (14) and terminal fittings (12) are mounted in the terminal holding portion (14). Ends of the terminal fittings (12) project back from the terminal holding portion (14) and are connected with a circuit board (K). Deformation permitting recesses (25) are formed around the terminal fittings (12) in the terminal holding portion (14) for permitting displacement of the terminal fittings (12) in directions intersecting the longitudinal directions of the terminal fittings (12). The deformation permitting recesses (25) are formed to leave a reinforcing portion (26) for maintaining the strength of the terminal holding portion (14).

14 Claims, 11 Drawing Sheets

CONNECTOR

BACKGROUND OF THE INVENTION

1. Field of the Invention

The invention relates to a circuit board connector.

2. Description of the Related Art

Japanese Unexamined Patent Publication No. H05-326049 discloses a circuit board connector with a housing to be mounted on a circuit board. The housing has a terminal holding portion for holding terminal fittings. Portions of the terminal fittings project back from the terminal holding portion and are bent for connection with the circuit board.

The circuit board and the housing may displace relative to one another, for example, due to a difference between their thermal expansion coefficients. As a result, the portions of the terminal fittings that project back from the terminal holding portion displace in directions intersecting the longitudinal directions of the terminal fittings to absorb forces that accompany the displacements.

An improvement in this force absorbing performance is required in some instances. The movable portions of the terminal fittings could be elongated to improve the force absorbing performance. However, this elongation enlarges the entire connector. The terminal holding portion also could be thinned to improve the force absorbing performance. However the thinner terminal holding portion may not have sufficient strength. Thus, this problem could not be easily dealt with.

The present invention was developed in view of the above problem and an object thereof is to improve a force absorbing performance without enlarging the connector and without reducing the strength.

SUMMARY OF THE INVENTION

The invention is directed to a circuit board connector with a housing that includes a terminal holding portion for holding at least one terminal fitting so that the terminal fitting projects back from the terminal holding portion. The end of the projecting portion of the terminal fitting is connectable with a circuit board. At least one deformation permitting area is formed in the terminal holding portion around the terminal fitting for permitting displacements of the terminal fittings in directions intersecting with the longitudinal direction of the terminal fitting. A reinforcement is provided for maintaining the strength of the terminal holding portion.

A postformed portion may be formed around the housing.

The terminal holding portion preferably has a wall that extends back from the terminal fittings. The wall is held by molds used during the postforming, and the reinforcement preferably couples the wall and the terminal holding portion.

The terminal holding portion preferably has a main body and an intermediate terminal holder assembled at the front of the main body. The terminal fitting preferably has a terminal main body mounted in the main body of the terminal holding portion and projecting back therefrom. The terminal fitting also preferably has an intermediate terminal mounted in the intermediate terminal holder. The intermediate terminal has front and rear connecting portions. The rear connecting portion is connectable with the terminal main body as the intermediate terminal holder is assembled with the main body of the terminal holding portion. The front connecting portion connects with a mating terminal as the housing is connected with a mating housing.

The housing and the circuit board may displace relative to each other. As a result, the terminal fitting will displace in the deformation permitting area in directions intersecting the longitudinal direction of the terminal fitting to absorb forces associated with the relative displacement. The terminal holding portion has the reinforcement. Thus, force absorption is improved without enlarging the circuit board connector and without weakening the terminal holding portion.

A sufficient strength is ensured for the terminal holding portion. Thus, the terminal holding portion will not be deformed by an injection pressure of a resin material filled into the mold during postforming.

Postforming can be carried out more suitably by the reinforcing wall that reinforces the wall held by the mold for postforming.

DETAILED DESCRIPTION OF THE PREFERRED EMBODIMENTS

Figure 1:
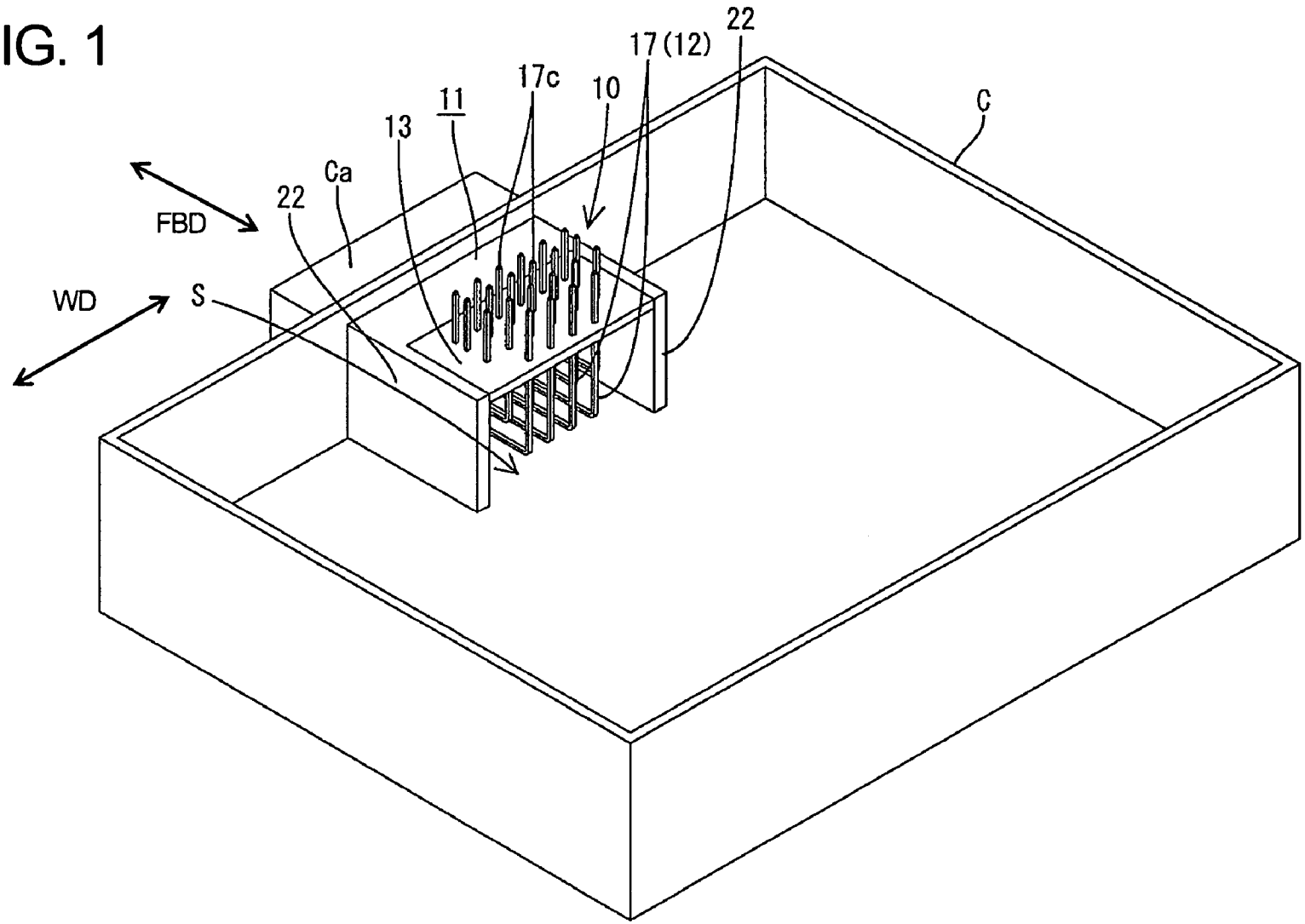
FIG. 1 is a schematic perspective view of a casing and a circuit board connector according to a first embodiment of the invention.
Figure 2:
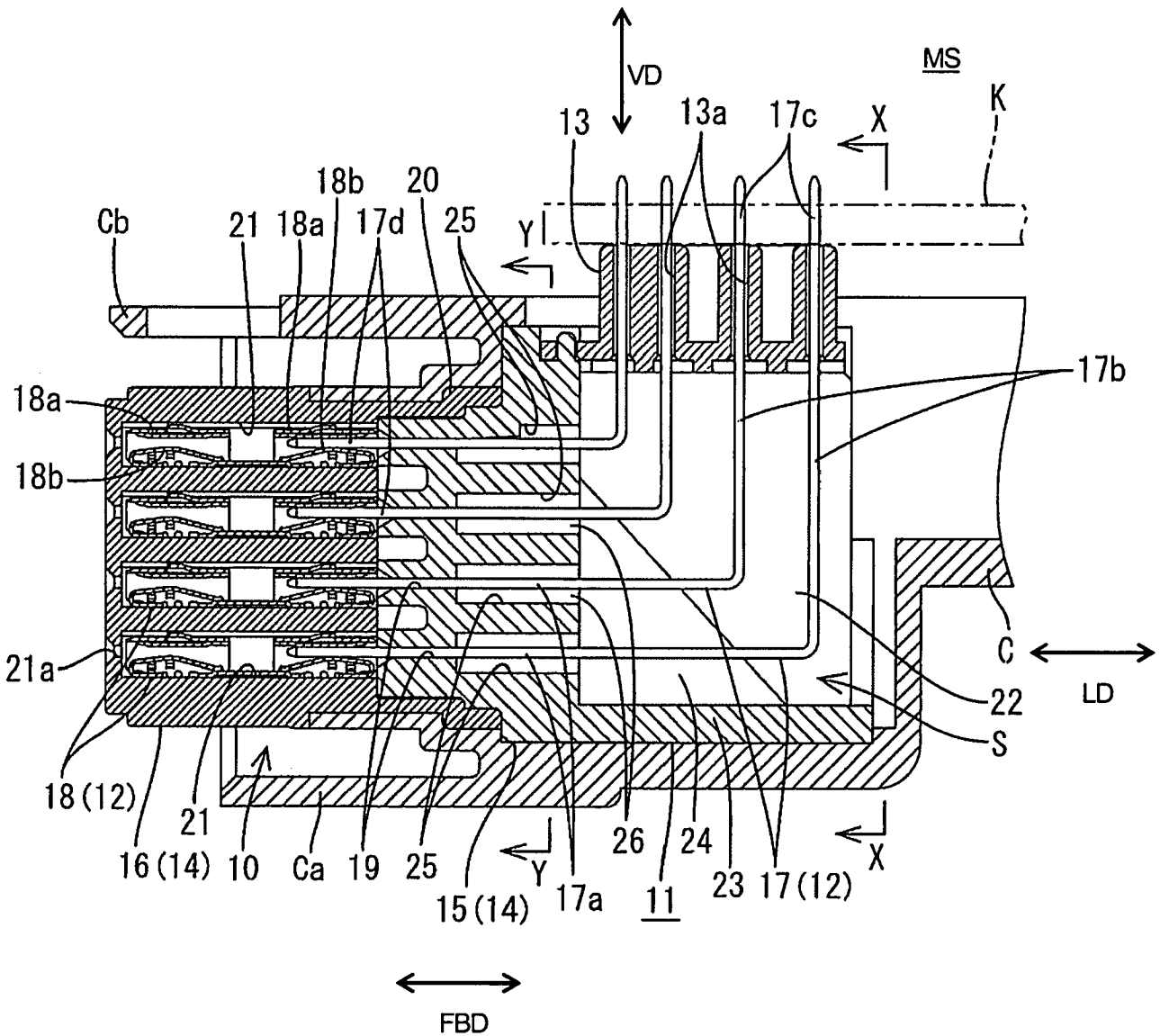
FIG. 2 is a side view in section of the casing and the circuit board connector.

A circuit board connector according to the invention is identified by the numeral 10 in FIGS. 1 to 8. The circuit board connector 10 is to be connected with a circuit board K of an ECU (electronic control unit) installed in an automotive vehicle. In this example, a casing C of the ECU is formed around a housing 11 by postforming. In this regard, postforming refers to a process where the casing C is molded at least partly around the previously molded housing 11. Thus, the housing 11 is partly surrounded by and engaged integrally with a unitary matrix of resin of the casing C. The end of the housing 11 to be connected with a mating male connector is referred to herein as the front and the opposite end thereof is the rear. Reference is made to FIG. 2 concerning the vertical direction VD.

The casing C is made of a synthetic resin and defines a shallow box with an open upper end, as shown in FIG. 1. The circuit board K is mounted at an open mounting side MS of the casing C. The housing 11 of the circuit board connector 10 is embedded in a bottom wall and a side wall of the casing C at a position below the circuit board K.

The housing 11 of the circuit board connector 10 is made of a synthetic resin. Terminal fittings 12 are held in the housing 11, and an alignment plate 13 is mounted on the housing 11, as shown in FIG. 2. The housing 11 has a terminal holding portion 14 for holding the terminal fittings 12 so that the terminal fittings 12 project back from the terminal holding portion 14. The terminal holding portion 14 has a main body 15 and an intermediate terminal holder 16 that is assembled on the front of the main body 15. Each terminal fitting 12 has a terminal main body 17 mounted in the main body 15 and an intermediate terminal 18 mounted in the intermediate terminal holder 16. A front half of the intermediate terminal holder 16 of the housing 11 is outside at one side surface of the casing C and is surrounded by a tubular part Ca of the casing C. A receptacle of the mating male connector is fittable between the tubular part Ca and the front half of the intermediate terminal holder 16. Further, a lock arm Cb is cantilevered at an upper side of the tubular part Ca of the casing C for holding the mating male connector.

The main body 15 is substantially block-shaped and terminal insertion holes 19 penetrate the main body 15 in forward and backward directions for receiving the terminal main bodies 17 from an inserting side IS at the front. Six terminal insertion holes 19 are arranged side-by-side along the width direction at each of three stages and four terminal insertion holes 19 are side-by-side at the uppermost stage. Slanted surfaces are formed at the front edges of the terminal insertion holes 19 for guiding the insertion of the terminal main bodies 17. Each terminal main body 17 is a long narrow plate bent at a substantially right angle at an intermediate position to extend up towards the opening of the casing C and to define a substantially L-shape. Thus, each terminal main body 17 has that a horizontal part 17*a* extending along forward and backward directions FBD and a vertical part 17*b* extending in the vertical direction VD from the horizontal part 17*a*. A board side connecting portion 17*c* is formed at the upper end of the vertical part 17*b* of the terminal main body 17 and is insertable into a corresponding hole of the circuit board K for connection with a conductor path of the circuit board K by soldering, press fitting, welding or the like. An intermediate-terminal side connecting portion 17*d* is formed at the front end of the horizontal part 17*a* and projects forward from the main body 15. Upper ends of the board side connecting portions 17*c* of the terminal main bodies 17 are aligned and the front ends of the intermediate-terminal side connecting portions 17*d* are aligned. The horizontal parts 17*a* and the vertical parts 17*b* of the terminal main bodies 17 are longer at lower stages, and the bends of the terminal main bodies 17 are more backward at lower stages. A front end of the main body 15 is stepped to narrow in conformity with the shape of the intermediate terminal holder 16.

The intermediate terminal holder 16 is substantially block-shaped, and a fittable tube 20 projects back at the rear end of the intermediate terminal holder 16 to fit on the front end of the main body 15. Terminal accommodating chambers 21 are formed in the intermediate terminal holder 16 and have open rear ends for receiving the intermediate terminals 18. The terminal accommodating chambers 21 are at positions conforming to the respective terminal insertion holes 19 of the main potion 15, and insertion holes 21*a* are formed in the front walls for receiving mating male terminals of the mating male connector. Each intermediate terminal 18 has a pair of connecting portions 18*a* arranged substantially symmetrically and identically one after the other. Accordingly, the intermediate terminal 18 can be inserted into the terminal accommodating chamber 21 regardless of which connecting portion 18*a* faces forward. Both connecting portions 18*a* are substantially in the form of boxes having open front and rear ends, and a resilient contact piece 18*b* is cantilevered in each connecting portion 18*a* for resiliently touching the intermediate-terminal side connecting portion 17*d* of the terminal main body 17 or the mating male terminal. With the intermediate terminal 18 accommodated in the terminal accommodating chamber 21, the connecting portion 18*a* at the front is connected with the mating male terminal and the connecting portion 18*a* at the rear is connected with the terminal main body 17.

Side walls 22 extend back from the opposite lateral edges of the rear surface of the main body 15 and cover portions of the terminal main bodies 17 projecting back from opposite sides. The alignment plate 13 for aligning the board side connecting portions 17*c* of the respective terminal main bodies 17 can be held between the upper ends of the side walls 22. Positioning holes 13*a* are formed in the alignment plate 13 at positions corresponding to holes of the circuit board K and receive the board side connecting portions 17*c* of the terminal main bodies 17. Both side walls 22 reach a position more backward than the rear ends of the terminal main bodies 17 at the bottommost stage, and molds M used for postforming the casing C can be brought into contact with the rear end surfaces and the upper end surfaces of the side walls 22.

A bottom wall 23 extends back from the bottom end of the rear surface of the main body 15 for covering the rearwardly projecting portions of the terminal main bodies 17 from below, which is the side opposite from the opening of the casing C. The bottom wall 23 extends between the bottom ends of the side walls 22, but extends farther back than the side walls 22. The molds M for postforming the casing C can contact the upper end surfaces and the rear end surfaces of the side walls 22. The end surfaces of both side walls 22 and the bottom wall 23 are held by the molds M substantially over the entire periphery during the postforming in this way. Thus, there is no inflow of a molten resin into a space S enclosed by the side walls 22 and the bottom wall 23. Accordingly, the portions of the terminal main bodies 17 in the space S can deform resiliently without being covered by the resin of the casing C.

Figure 3:
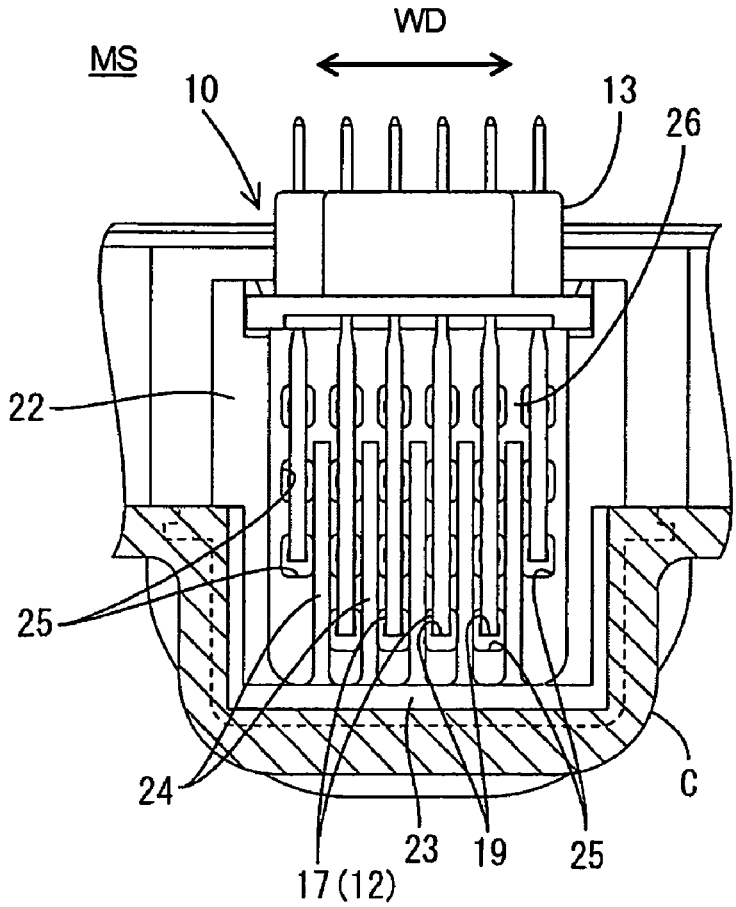
FIG. 3 is a cross-sectional view taken along line 3-3 of FIG. 2.

As shown in FIGS. 2 and 3, reinforcing walls 24 are provided on the rear surface of the main body 15 and are coupled to the upper surface of the bottom wall 23 for reinforcing the bottom wall 23. The reinforcing walls 24 are substantially triangular in side view. Five reinforcing walls 24 are arranged along the width direction at positions for partitioning the respective terminal insertion holes 19. The reinforcing walls 24 align the portions of the terminal main bodies 17 in the space S during insertion of the terminal main bodies 17 into the terminal insertion holes 19 or during bending of the terminal main bodies 17.

Figure 4:
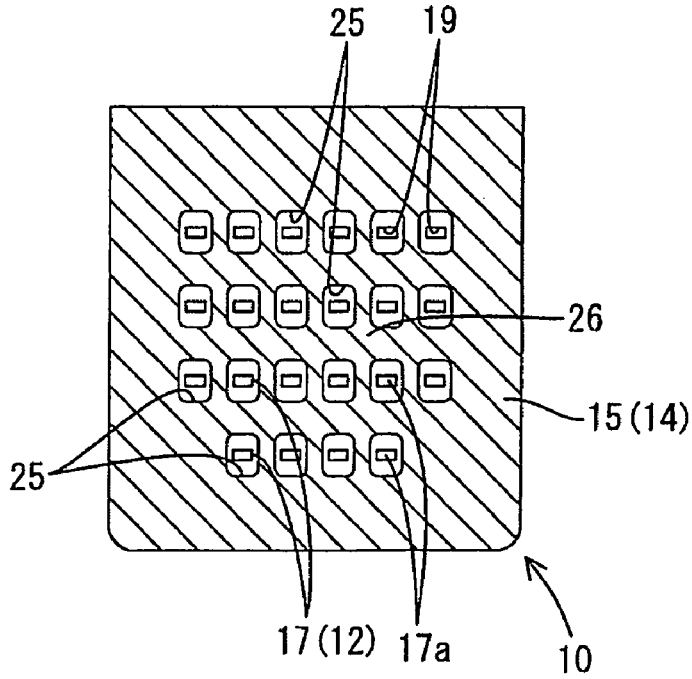
FIG. 4 is a cross-sectional view taken along line 4-4 of FIG. 2.

As shown in FIGS. 2 to 4, a rearwardly open displacement permitting recess 25 is formed in a peripheral edge of each terminal insertion hole 19 in the main body 15 for permitting the horizontal part 17*a* of the terminal main body 17 to displace in directions intersecting the longitudinal direction LD of the horizontal part 17*a*. More specifically, each displacement permitting recess 25 has a depth that is more than half and preferably about ⅔ of the dimension of the main body 15 along forward and backward directions FBD. A front portion of the horizontal part 17*a* of the terminal main body 17 is supported tightly in the terminal insertion hole 19, while a rear portion of the horizontal part 17*a* can deform freely along the vertical direction VD and the width direction WD within a range of the dimensions of the recess 25. The circuit board K and the housing 11 may be displaced relative to each other, for example, due to a difference between their thermal expansion coefficients. However, forces that act on the terminal main bodies 17 due to the differential expansion can be absorbed. It should be noted that an upper part of the displacement permitting recess 25 formed at each terminal insertion hole 19 at the uppermost stage has a depth that is about half the depth of a lower part thereof.

The displacement permitting recesses 25 have substantially rectangular cross-sections when viewed from the rear and extend along the outer shapes of the terminal insertion holes 19. Adjacent displacement permitting recesses 25 are independent of each other. Thus, a substantially lattice-shaped reinforcement 26 is left around the displacement permitting recesses 25 to suppress the deformation of the main body 15. The inner side surfaces of the respective displacement permitting recesses 25 are spaced apart sufficiently in the width direction WD to be substantially flush with the side surfaces of the reinforcing walls 24.

Figure 5:
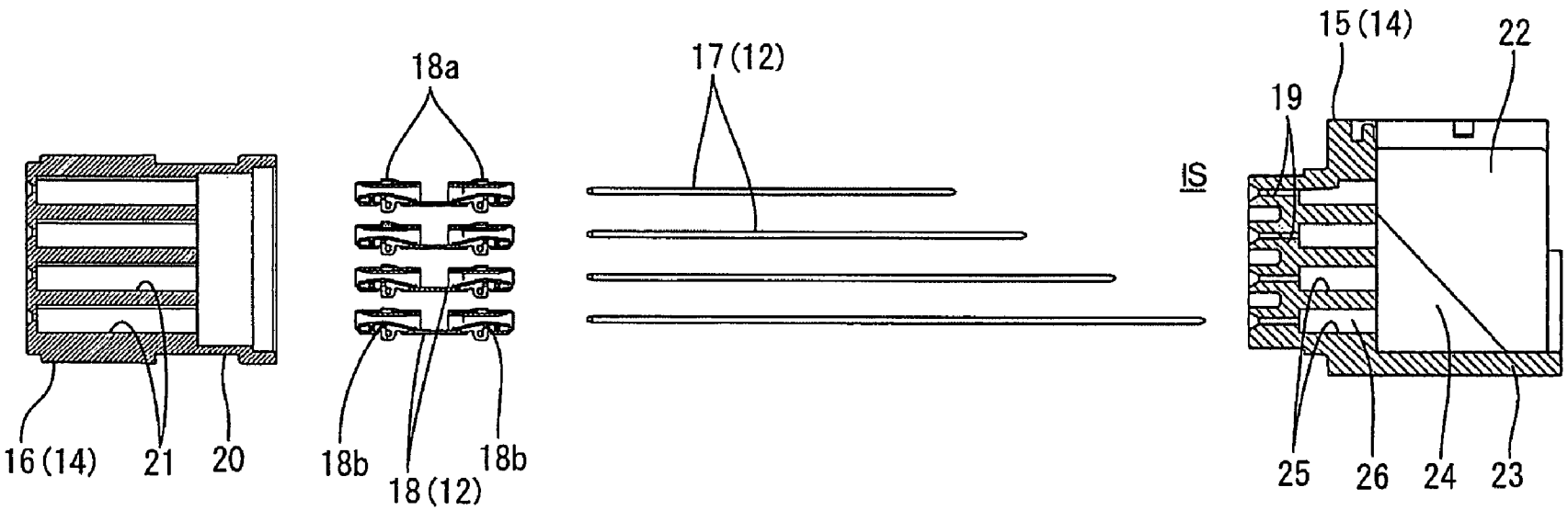
FIG. 5 is a side view in section showing a state before terminal main bodies are accommodated into a main body and intermediate terminals are accommodated into an intermediate terminal holder.
Figure 6:
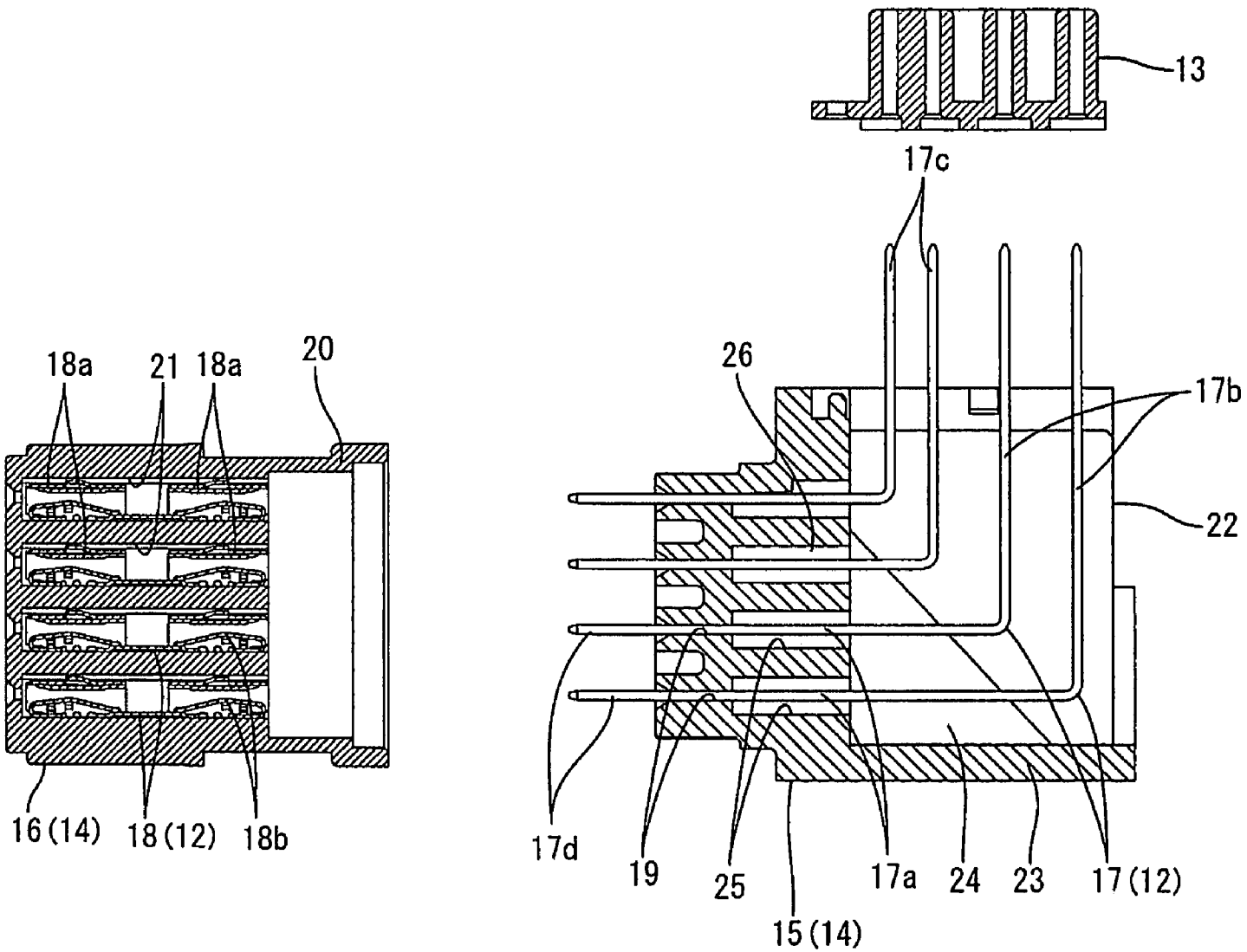

The terminal main bodies 17 are aligned substantially straight along forward and backward directions FBD, as shown in FIG. 5, and are inserted into the respective terminal insertion holes 19 of the main body 15 from the inserting side IS at the front. The terminal main bodies 17 are inserted to predetermined positions where the front ends of the intermediate-terminal side connecting portions 17*d* align. Portions of the terminal main bodies 17 that project back from the main body 15 then are bent up substantially at right angles by a jig or the like, as shown in FIG. 6. The alignment plate 13 then is mounted between the upper ends of both side walls 22 so that the board side connecting portions 17*c* of the respective terminal main bodies 17 are inserted through the corresponding positioning holes 13*a*. As a result, the board side connecting portions 17*c* are positioned with respect to the corresponding holes of the circuit board K (see FIG. 7).

Figure 7:
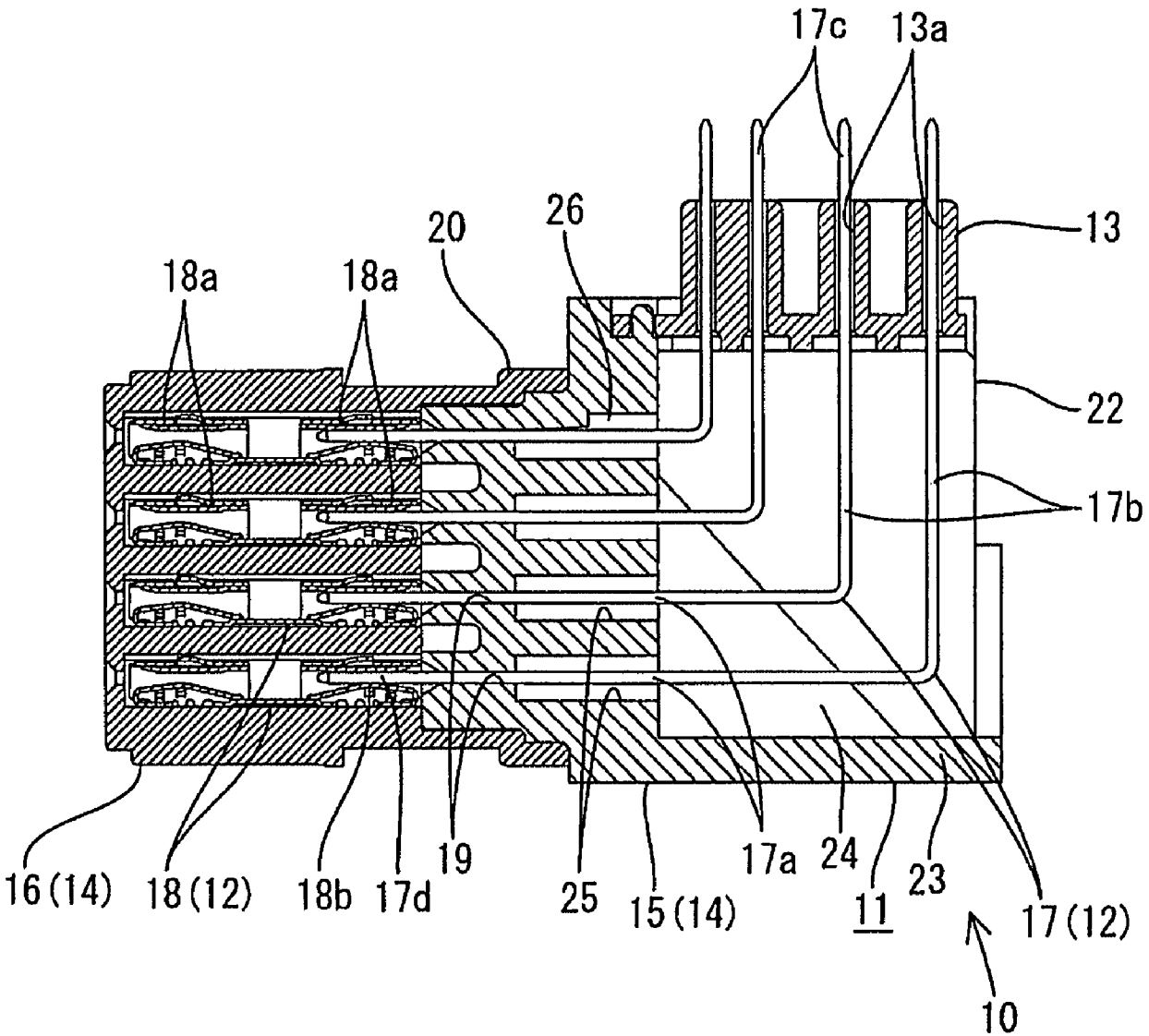
FIG. 7 is a side view in section showing the terminal main bodies in the main body and the intermediate terminals in the intermediate terminal holder.

The intermediate terminals 18 are inserted from behind into the respective terminal accommodating chambers 21 of the intermediate terminal holder 16. The front and rear parts of the intermediate terminals 18 are symmetrical. As a result, the intermediate terminals 18 can be accommodated regardless of which end faces forward, and assembly mistakes are not likely. The fittable tube 20 of the intermediate terminal holder 16 is fit on the front end of the main body 15. Simultaneously, the intermediate-terminal side connecting portions 17*d* of the terminal main bodies 17 enter the rear connecting portions 18*a* of the corresponding intermediate terminals 18 and resiliently touch the resilient contact pieces 18*b*, as shown in FIG. 7.

Figure 8:
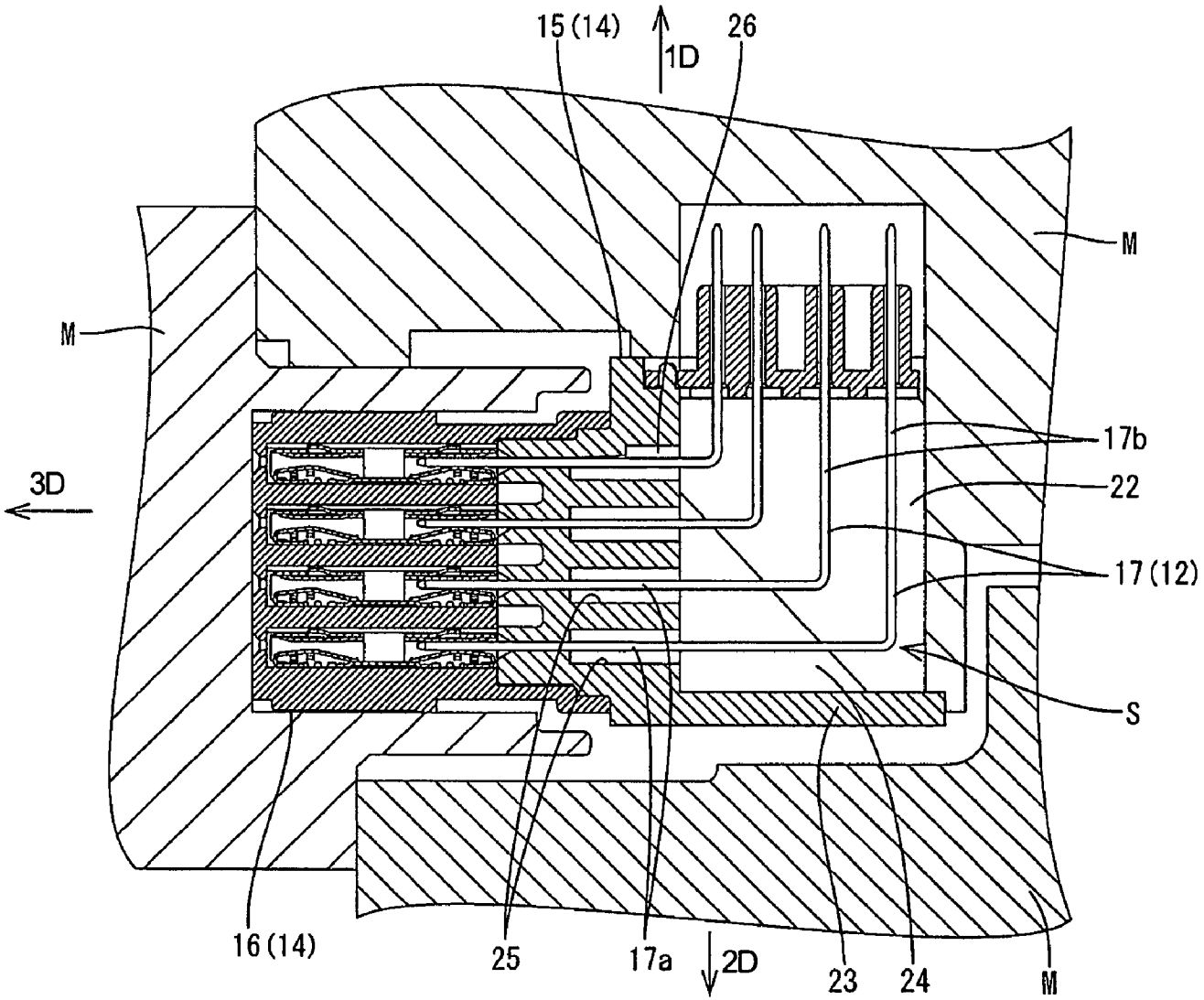
FIG. 8 is a side view in section showing a state where the circuit board connector is set in molds for postforming.

The casing C is formed around the housing 11 after the above-described circuit board connector 10 is assembled. As shown in FIG. 8, the circuit board connector 10 is set in molds M for postforming. The housing 11 is held by three molds M that move up (direction 1D), down (direction 2D) and sideways (direction 3D) to open. More particularly, the housing 11 has the end surfaces of both side walls 22 and the bottom wall 23 held substantially over the entire periphery by the mold M that is moved up towards the opening of, the casing C to open. Accordingly, the resin will not intrude into a space enclosed by the side walls 22 and the bottom wall 23 as molten resin is filled into a resin filling space of the molds M. Injection pressure of the resin acts on the surrounding surface of the housing 11 facing the resin filling space. However, the lattice-shaped reinforcement 26 gives sufficient strength to the main body 15 to offset any weakening attributable to the displacement permitting recesses 25. As a result, the injection pressure will not deform the main body 15. Likewise, the injection pressure of the resin acts on the bottom wall 23. However, the reinforcing walls 24 prevent the injection pressure from deforming the bottom wall 23.

The molds M are opened after the resin is cooled and solidified to define an article that has the casing C post-formed or overmolded around the housing 11, as shown in FIG. 2. The circuit board K is mounted at the opening of the casing C, and the board side connecting portions 17*c* of the terminal main bodies 17 inserted through the respective holes are soldered into electrical connection with the corresponding conductor paths. The mating male connector then is fit to the fitting portion of the circuit board connector 10 from outside the casing C to connect the mating male terminals with the front connecting portions 18*a* of the intermediate terminals 18. In this way, the mating male terminals are connected electrically with the terminal main bodies 17 and to the circuit board K via the intermediate terminals 18.

The assembled circuit board connector 10 is installed in an automotive vehicle, and is likely to be used in a high-temperature environment. Thus, the housing 11 and the circuit board K may be displaced relative to each other due to different thermal expansion coefficients of the resin of the housing 11 and the resin of the circuit board K. However, portions of the terminal main bodies 17 that project back from the main body 15 deform resiliently and escape into spaces surrounding them. Thus, forces on the terminal main bodies 17 due to the displacement are absorbed. Further, the horizontal parts 17*a* of the terminal main bodies 17 are in the main body 15 and are deformed resiliently into the displacement permitting recesses 25. Therefore, the force absorbing performance is good.

As described above, the displacement permitting recesses 25 are formed around the terminal main bodies 17 in the main body 15 for permitting displacements of the terminal main bodies 17 in directions intersecting the longitudinal directions of the terminal main bodies 17. The deformation permitting recesses 25 leave the lattice-shaped reinforcement 26 to maintain the strength of the main body 15. Thus, the force absorbing performance is improved without enlarging the entire connector and without reducing the strength of the main body 15.

Sufficient strength is ensured for the main body 15 even in the case of postforming the casing C around the housing 11. Thus, the main body 15 will not be deformed by the injection pressure of the resin filled into the space enclosed by the molds M during the postforming. Furthermore, the reinforcing walls 24 reinforce the bottom wall 23 held by the molds M during the postforming, thereby making the connector very suitable for postforming.

A second embodiment of the invention is described with reference to FIGS. 9 to 12. In the second embodiment, the intermediate terminals and the like of the first embodiment are omitted.

Figure 9:
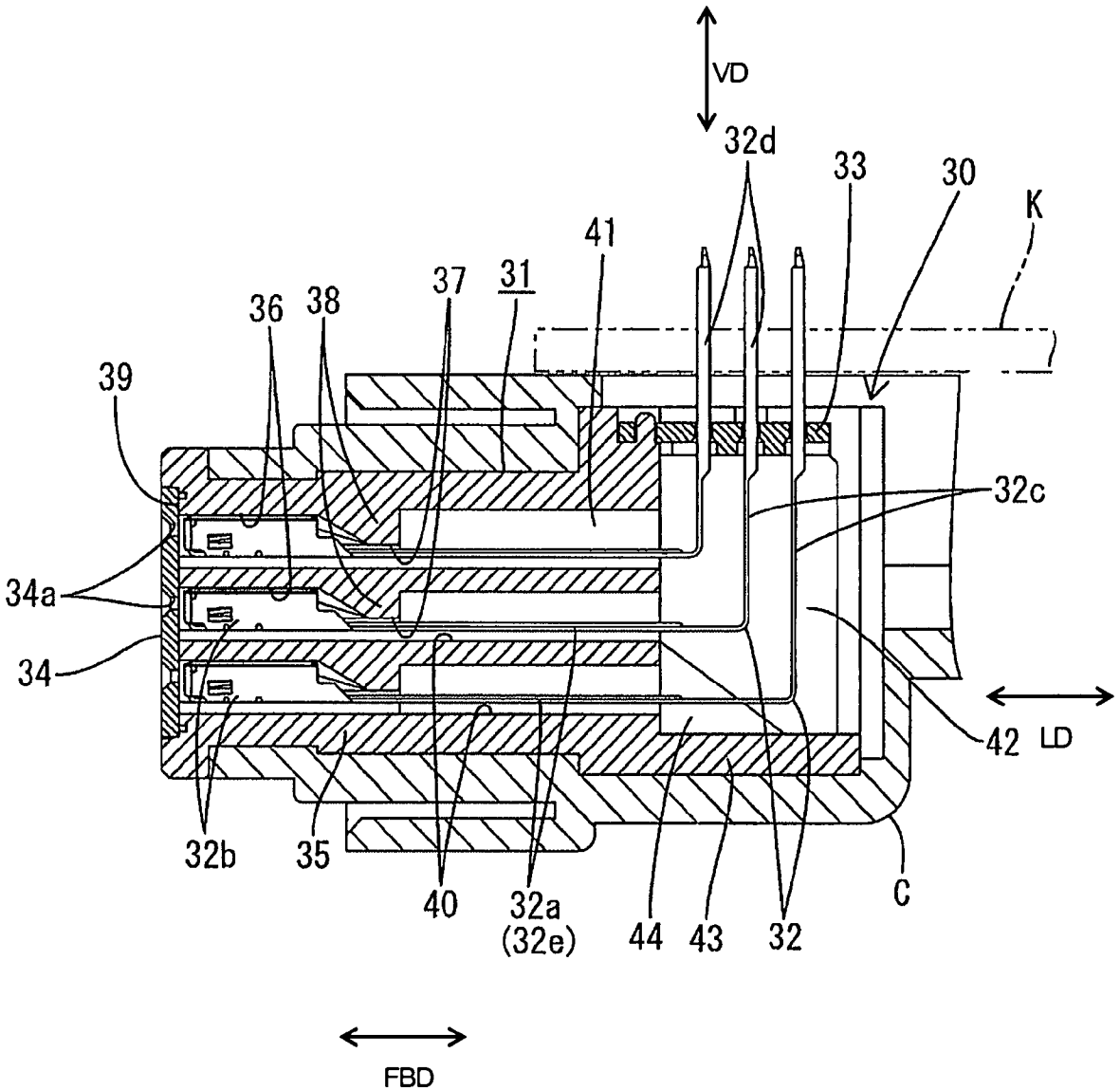
FIG. 9 is a side view in section of a casing and a circuit board connector according to a second embodiment of the invention.

As shown in FIG. 9, a circuit board connector 30 has a housing 31 with a terminal holding portion 35, and terminal fittings 32 are held in the housing 31. The connector 30 also has an alignment plate mounted on the housing 31, and a retainer 34. Each terminal fitting 32 has a substantially L-shaped plate 32*a* bent at an intermediate position and a substantially box-shaped connecting portion 32*b* at the front end of the plate 32*a*. The connecting portion 32*b* has open front and rear ends and is provided integrally with a resilient contact piece (not shown) for resiliently contacting a mating male terminal. The plate 32*a* has a vertical part 32*c* and a board side connecting portion 32*d* is formed at the upper end of the vertical part 32*c* for connection with a circuit board K. Accommodating chambers 36 are formed in the terminal holding portion 35 of the housing 31 for accommodating the connecting portions 32*b* of the terminal fittings 32 and insertion holes 37 are formed behind the accommodating chambers 36 for receiving the plates 32*a*. The accommodating chambers 36 and insertion holes 37 are arranged side by side along the width direction WD at upper, middle and bottom stages. A restriction 38 is formed at the rear end of each accommodating chamber 36 for contacting the rear end of the connecting portion 32*b* and restricting an inserted depth of the terminal fitting 32. A mounting recess 39 is formed in the front surface of the terminal holding portion 35 and receives the retainer 34 for retaining the accommodated terminal fittings 32. The retainer 34 is substantially a plate that fits into the mounting recess 39. Introducing holes 34*a* penetrate the retainer 34 at positions corresponding to the accommodating chambers 36 for permitting entry of the mating male terminals. The retainer 34 is fixed to the terminal holding portion by vibration welding, snap-fitting, adhesive or the like.

Rearwardly open deformation permitting recesses 40 are formed behind the respective insertion holes 37 of the terminal holding portion 35 for permitting displacement of horizontal parts 32*e* of the plates 32*a* of the terminal fittings 32 in directions intersecting the longitudinal directions LD of the horizontal parts 32*a*. Each deformation permitting recess 40 has a depth that is about half the length of the terminal holding portion 35 along forward and backward directions. The front ends of the horizontal parts 32*e* of the plates 32*a* are supported closely by the peripheral edges of the insertion holes 37. However, portions of the horizontal parts 32*e* behind the front ends are freely resiliently deformable along the vertical direction VD and width direction WD within a range of the dimensions of the recesses 40. The deformation permitting recesses 40 extend farther above horizontal parts 32*e* than below the horizontal parts 32*e*. A substantially lattice-shaped reinforcement 41 is left around the deformation permitting recesses 40 of the terminal holding portion 35 to ensure sufficient strength for the terminal holding portion 35. Two side walls 42, a bottom wall 43 and reinforcing walls 44 are provided at the rear of the terminal holding portion 35 as in the first embodiment. No detailed description is given for those structures that are similar to the first embodiment, including the alignment plate 33.

Figure 10:
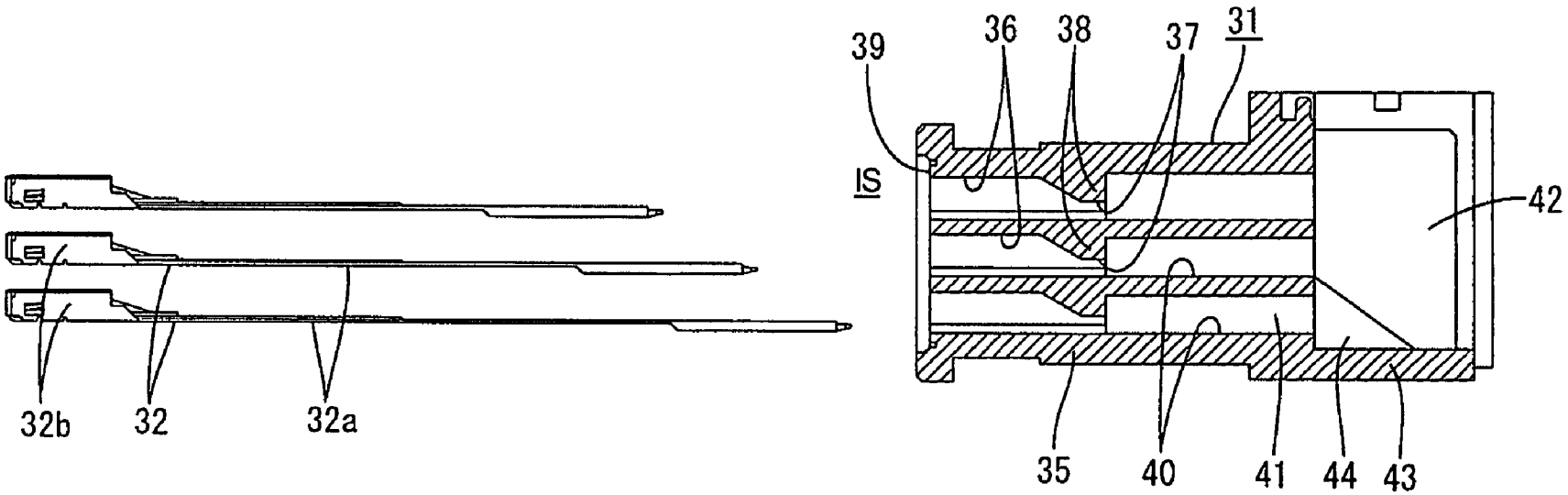
FIG. 10 is a side view in section showing a state before terminal fittings are accommodated into a housing.
Figure 11:
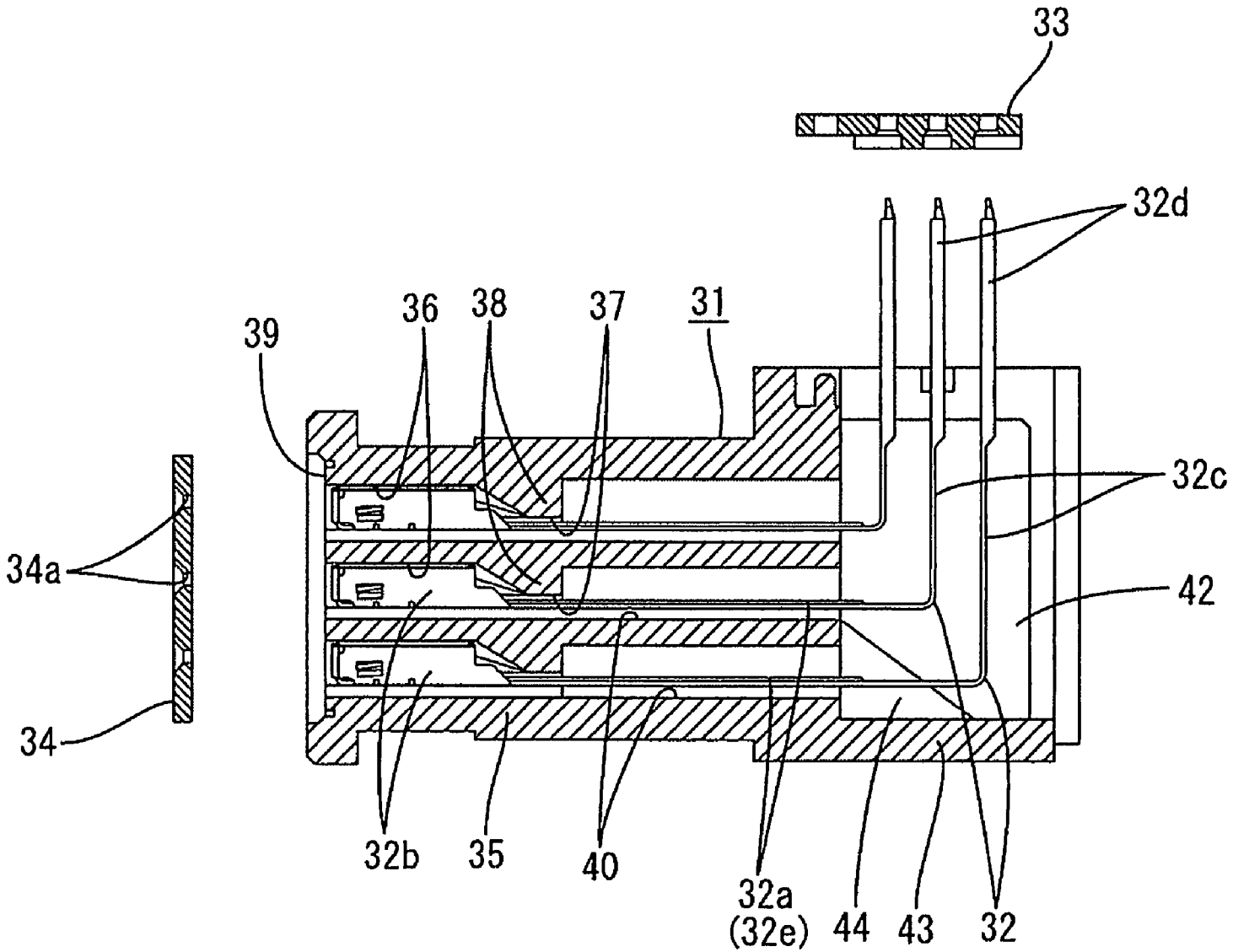
FIG. 11 is a side view in section showing a state where the terminal fittings are accommodated in the housing.
Figure 12:
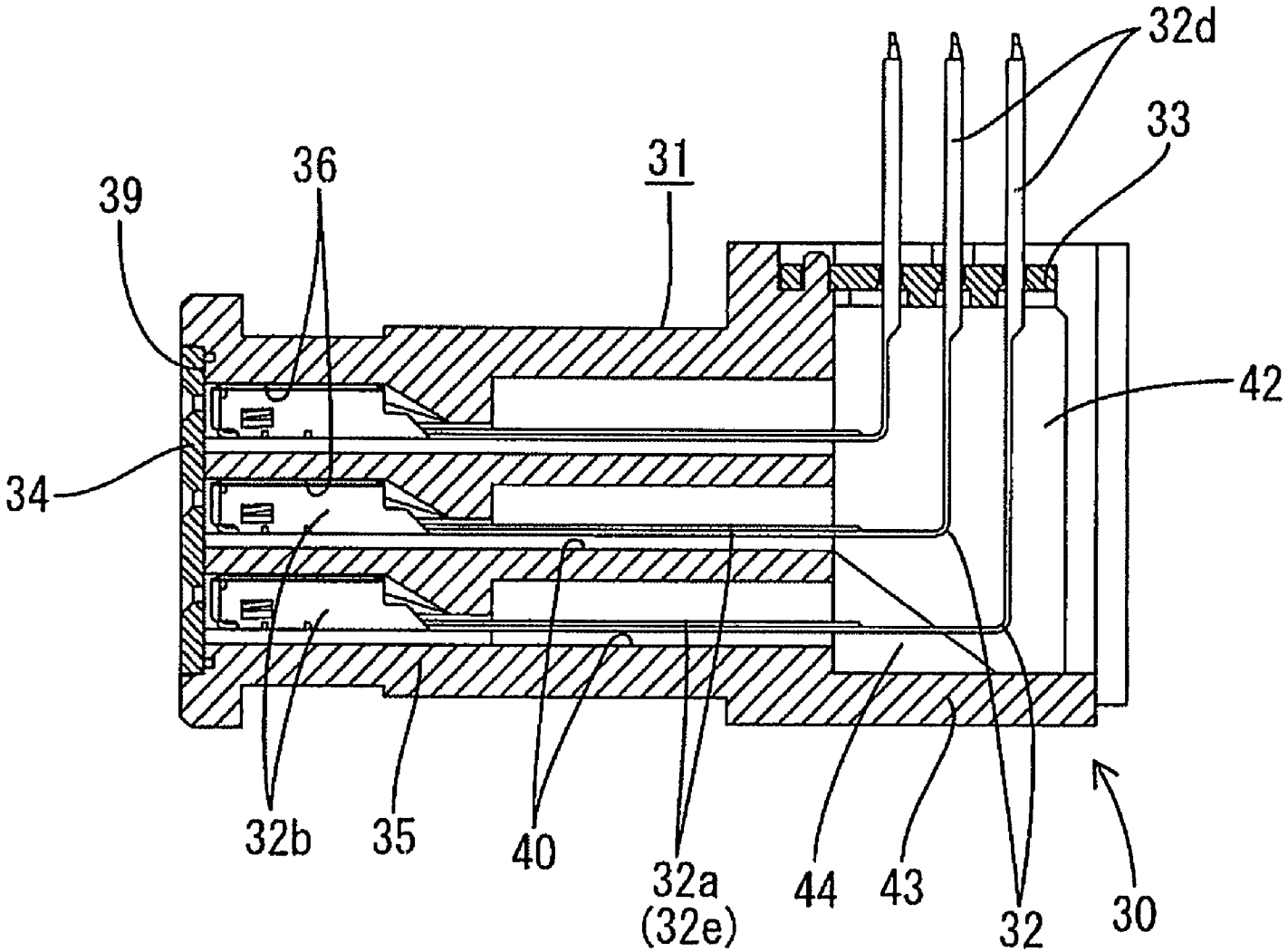
FIG. 12 is a side view in section showing a state where a retaining member and an alignment plate are assembled with the housing.

As shown in FIG. 10, the straight plates 32*a* of the terminal fittings 32 are inserted into the accommodating chambers 36 and the insertion holes 37 of the terminal holding portion 35 until the rear ends of the connecting portions 32*b* contact the restrictions 38. The plates 32*a* then are bent by a jig or the like as shown in FIG. 11. The alignment plate 33 then is mounted between the side walls 42, as shown in FIG. 12, to align the board side connecting portions 32*d*. The retaining member 34 then is fit into the mounting recess 39 and fixed, for example, by vibration welding to prevent the terminal fittings 32 from coming out forward. The assembled circuit board connector 30 then is set in a mold for postforming the casing C around the housing 31. The circuit board K is mounted and the respective board side connecting portions 32*d* are soldered, as shown in FIG. 9. A mating connector then can be fit to the front end of the terminal holding portion 35

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The deformation permitting recesses formed by cutting off portions of the terminal holding portion around the terminal fittings are shown in the foregoing embodiments. However, displacement permitting areas may be formed, for example, by providing resilient members for permitting displacements of the terminal fittings around the terminal fittings according to the present invention.

The terminal holding portion is provided with one pair of side walls in the foregoing embodiments. However, the side walls may be omitted. Even in such a case, the inflow of the resin into the inner space of the bottom wall can be prevented by suitably holding the end surface of the bottom wall by the molds during the postforming. The invention is also applicable to connectors produced without postforming the casing around the housing. In such a case, the bottom wall can also be omitted. The present invention is also applicable to connectors having no alignment plate.

Straight terminal fittings with no intermediate end can also be used in the present invention. Further, the number of the terminal fittings and the arrangement thereof in the housing can be changed.

Although the circuit board connector connectable with the mating male connector (its connecting part is of the female type) is shown in the foregoing embodiment, the present invention is also applicable to a circuit board connector connectable with a mating female connector (its connecting part is of the male type).

What is claimed is:

1. A connector for an electric or electronic device, the connector having a housing with a terminal holding portion having opposite front and rear ends and terminal insertion holes extending in a longitudinal direction between the front and rear ends, terminal fittings having at least intermediate portions in the terminal insertion holes and have rear ends projecting rearwardly beyond the rear end of the terminal holding portion for connection with the electric or electronic device, the housing having a substantially lattice-shaped reinforcement spaced outwardly from the respective terminal fittings at the rear end of the terminal holding portion and defining displacement permitting areas at least partly around the terminal fittings for permitting displacements of the terminal fittings in directions intersecting longitudinal directions, the terminal holding portion including at least one wall extending back beyond the terminal fittings and reinforcing walls coupling the wall to the lattice-shaped reinforcement at the rear of the terminal holding portion.

2. The connector of claim 1, further comprising a postformed portion molded at least partly around the housing to define a unitary matrix of resin surrounding and engaging portions of the housing.

3. A connector for an electric or electronic device, the connector having a housing with a terminal holding portion for holding terminal fittings, ends of the terminal fittings being connectable with the electric or electronic device, wherein the terminal holding portion has displacement permitting areas formed at least partly around the terminal fittings for permitting displacements of the terminal fittings in directions intersecting longitudinal directions of the terminal fittings, the terminal holding portion further having at least one reinforcement for reinforcing the terminal holding portion, the terminal holding portion including at least one base wall extending back beyond the terminal fittings and a reinforcing wall coupling the base wall and the terminal holding portion, the connector further comprising a postformed portion molded at least partly around the housing.

4. The connector of claim 1, wherein the terminal holding portion includes a main body and an intermediate terminal holder assembled to a mounting side of the main body.

5. The connector of claim 4, wherein each displacement permitting area has a depth measured parallel to the longitudinal directions that is more than about half of a length dimension of the main body measured parallel to the longitudinal direction.

6. The connector of claim 5, wherein a part of the terminal main body in a terminal insertion hole of the main body has a first portion less than about half of the length dimension of the main body along the longitudinal direction that is tightly supported by the terminal insertion hole while having a second portion freely resiliently deformable in directions intersecting the longitudinal directions of the terminal fittings within the displacement permitting areas.

7. A connector for an electric or electronic device, the connector having a housing with a terminal holding portion for holding terminal fittings, ends of the terminal fittings being connectable with the electric or electronic device, the terminal holding portion having displacement permitting areas formed at least partly around the terminal fittings for permitting displacements of the terminal fittings in directions intersecting longitudinal directions of the terminal fittings, at least one reinforcement for reinforcing the terminal holding portion, the terminal holding portion including a main body and an intermediate terminal holder assembled to a mounting side of the main body, and wherein each terminal fitting includes:

a terminal main body mounted in the main body and projecting back therefrom;

an intermediate terminal mounted in the intermediate terminal holder; and each intermediate terminal includes front and rear connecting portions, the rear connecting portion being connectable with the corresponding terminal main body as the intermediate terminal holder is assembled with the main body, and the front connecting portion being connectable with a mating terminal in a mating connector to be connected with the housing.

8. A connector for an electric or electronic device, the connector having a housing with a terminal holding portion having opposite front and rear ends and terminal insertion holes extending in a longitudinal direction between the front and rear ends, the terminal holding portion further having a mounting face for disposition in opposed facing relationship to the electric or electronic device, terminal fittings having at least intermediate portions in the terminal insertion holes and having rear portions projecting rearwardly beyond the rear end of the terminal holding portion and being bent towards a mounting face of the terminal holding portion for connection with the electric or electronic device, the housing having a plurality of walls defining a substantially lattice-shaped reinforcement spaced outwardly from portions of the respective terminal fittings at the rear end of the terminal holding portion and defining displacement permitting areas at least partly around the terminal fittings including areas of the terminal fittings facing towards the mounting face for permitting displacements of the terminal fittings in directions intersecting the longitudinal directions.

9. The connector of claim 8, wherein the terminal holding portion includes at least one wall extending back beyond the terminal fittings.

10. The connector of claim 8, further comprising an intermediate terminal holder assembled to a mounting side of the terminal holding portion.

11. The connector of claim 8, wherein the front and rear ends of the terminal holding portion are spaced from one another by a selected distance, the displacement permitting areas extending forward from the rear end of the terminal holding portion by a distance greater than one half a distance between the front and rear ends of the terminal holding portion.

12. The connector of claim 8, wherein walls of the substantially lattice-shaped reinforcement define the displacement permitting areas completely around portions of the terminal fittings adjacent the rear end of the terminal holding portion.

13. The connector of claim 12, wherein a dimension of the displacement permitting areas on sides of the terminal fittings facing the mounting face of the terminal main body exceed dimensions of the displacement permitting area on a side of the terminal fitting opposite the mounting face.

14. A connector for an electric or electronic device, the connector having a housing with a terminal holding portion having opposite front and rear ends and terminal insertion holes extending in a longitudinal direction between the front and rear ends, terminal fittings having at least intermediate portions in the terminal insertion holes and have rear ends projecting rearwardly beyond the rear end of the terminal holding portion for connection with the electric or electronic device, the housing having a substantially lattice-shaped reinforcement spaced outwardly from the respective terminal fittings at the rear end of the terminal holding portion and defining displacement permitting areas at least partly around the terminal fittings for permitting displacements of the terminal fittings in directions intersecting longitudinal directions, an intermediate terminal holder assembled to a mounting side of the terminal holding portion, and wherein each terminal fitting includes a terminal main body mounted in the terminal holding portion and an intermediate terminal mounted in the intermediate terminal holder, each intermediate terminal includes substantially identical front and rear connecting portions, the rear connecting portion being connectable with the corresponding terminal main body as the intermediate terminal holder is assembled with the terminal holding portion, and the front connecting portion being connectable with a mating terminal in a mating connector to be connected with the housing.

* * * * *